US009840995B2

(12) United States Patent
Kuroyanagi et al.

(10) Patent No.: US 9,840,995 B2
(45) **Date of Patent: *Dec. 12, 2017**

(54) HIGH-PRESSURE PUMP

(71) Applicant: DENSO CORPORATION, Kariya, Aichi-pref. (JP)

(72) Inventors: Masatoshi Kuroyanagi, Kariya (JP); Mamoru Urushizaki, Chiryu (JP); Yasuaki Matsunaga, Anjo (JP)

(73) Assignee: DENSO CORPORATION, Kariya (JP)

( * ) Notice: Subject to any disclaimer, the term of this patent is extended or adjusted under 35 U.S.C. 154(b) by 22 days.

This patent is subject to a terminal disclaimer.

(21) Appl. No.: 14/609,918

(22) Filed: Jan. 30, 2015

(65) Prior Publication Data

US 2015/0139825 A1 May 21, 2015

Related U.S. Application Data

(62) Division of application No. 13/433,561, filed on Mar. 29, 2012.

(30) Foreign Application Priority Data

Mar. 31, 2011 (JP) ..... 2011-78484

(51) Int. Cl.
*F04B 19/22* (2006.01)
*F02M 59/10* (2006.01)
(Continued)

(52) U.S. Cl.
CPC ..... *F02M 59/102* (2013.01); *F02M 59/48* (2013.01); *F04B 7/04* (2013.01);
(Continued)

(58) Field of Classification Search
CPC .... F04B 39/122; F04B 39/126; F04B 39/127; F04B 53/16; F02M 59/10; F02M 59/48
(Continued)

(56) References Cited

U.S. PATENT DOCUMENTS 3,207,081 A * 9/1965 Helmut Bauer ..... F04B 37/12 417/395
4,616,983 A * 10/1986 Hanafi ..... F04B 53/103 417/539
(Continued)

FOREIGN PATENT DOCUMENTS

JP 2001-295754 10/2001
JP 2004-138062 5/2004
(Continued)

OTHER PUBLICATIONS

Advisory Action dated Jun. 25, 2015, issued in parent U.S. Appl. No. 13/433,561 (4pages).
(Continued)

*Primary Examiner* — Thomas E Lazo
*Assistant Examiner* — Matthew Wiblin
(74) *Attorney, Agent, or Firm* — Nixon & Vanderhye P.C.

(57) ABSTRACT

During a pressurization stroke of a high-pressure pump, a cylinder inner wall and a plunger receive a fuel pressure from the pressurization chamber. Meanwhile, an upper housing does not receive the fuel pressure from the pressurization chamber, so that its thickness can be made thin. A cylinder is comprised of a bottom portion, a cylindrical portion and a large-diameter cylindrical portion. When inserting the large-diameter cylindrical portion into a large engaging hole, the bottom portion and the cylindrical portion are not brought into contact with a lower housing. A high liquid-tightness between the bottom portion, the cylindrical portion and a small engaging hole can be ensured.

7 Claims, 10 Drawing Sheets

(51) Int. Cl.

| | |
|---|---|
| ***F02M 59/48*** | (2006.01) |
| ***F04B 39/12*** | (2006.01) |
| ***F04B 39/14*** | (2006.01) |
| ***F04B 7/04*** | (2006.01) |

(52) U.S. Cl.
CPC ..... *F04B 19/22* (2013.01); *F04B 39/121* (2013.01); *F04B 39/122* (2013.01); *F04B 39/127* (2013.01); *F04B 39/14* (2013.01)

(58) Field of Classification Search
USPC ..... 92/169.4, 171.1
See application file for complete search history.

(56) References Cited

U.S. PATENT DOCUMENTS

| | | | | |
|---|---|---|---|---|
| 8,246,319 | B2 * | 8/2012 | Ohnishi | F04B 39/14 417/273 |
| 8,257,065 | B2 * | 9/2012 | Divisi | F04B 53/162 137/539 |
| 2004/0052664 | A1 | 3/2004 | Saito et al. | |
| 2007/0071614 | A1 | 3/2007 | Inoue | |
| 2008/0289713 | A1 * | 11/2008 | Munakata | F02M 55/04 138/26 |
| 2009/0123303 | A1 * | 5/2009 | Ohnishi | F04B 39/14 417/270 |
| 2009/0288639 | A1 * | 11/2009 | Usui | F02M 55/04 123/457 |
| 2010/0209274 | A1 * | 8/2010 | Oikawa | F04B 37/12 417/540 |
| 2012/0012084 | A1 * | 1/2012 | Petrone | F02M 59/06 123/468 |

FOREIGN PATENT DOCUMENTS

| | | |
|---|---|---|
| JP | 2009-185613 | 8/2009 |
| WO | 2006/069819 | 7/2006 |

OTHER PUBLICATIONS

Office Action (6 pgs.) dated Aug. 19, 2014, issued in corresponding Chinese Application No. 201210091002.7 and English translation (5 pgs.).

Office Action (6 pgs.) dated Jan. 6, 2014, issued in corresponding Chinese Application No. 201210091002.7 and English translation (5 pgs.).

Kuroyanagi, Office Action (10 pages) dated Feb. 25, 2016, issued in copending U.S. Appl. No. 13/433,561, filed Mar. 29, 2012.

Kuroyanagi et al., Final Office Action (12 pages) dated Mar. 16, 2015, issued in parent U.S. Appl. No. 13/433,561, filed Mar. 29, 2012.

Kuroyanagi, Office Action (12 pages) dated Jun. 30, 2016, issued in copending U.S. Appl. No. 13/433,561, filed Mar. 29, 2012.

* cited by examiner

HIGH-PRESSURE PUMP

CROSS-REFERENCE TO RELATED APPLICATION

This is a divisional of U.S. application Ser. No. 13/433,561, filed Mar. 29, 2012 which claims the benefit of Japanese Patent Application No. 2011-78484 filed on Mar. 31, 2011, the disclosures of both of which are incorporated herein by reference.

TECHNICAL FIELD

The present invention relates to a high-pressure pump which pressurizes and discharges a fuel.

BACKGROUND

A high-pressure pump has a plunger which reciprocates to pressurize fuel in a pressurizing chamber. When the plunger slides down, the fuel is suctioned into a pressurization chamber through a suction passage. When the plunger slides up, the metered quantity of fuel is pressurized to be discharged through a discharge passage. JP-2004-138062A shows such a high-pressure pump in which a cylinder engaged with a housing has a through-hole through which a plunger is slidably inserted. The pressurization chamber is defined between an inner wall of the housing and an outer wall of the plunger.

It has been required that a high-pressure fuel discharges large quantity of fuel in high pressure. A housing receiving high pressure force from a pressurization chamber should have enough thickness to endure the high pressure force. In the high-pressure pump shown in JP-2004-138062A, the housing is thick and heavy. Moreover, as the fuel pressure in the pressurization chamber becomes higher, higher sealing is required between the housing and the cylinder. If the cylinder is firmly engaged with the housing to enhance the sealing therebetween, it is likely that an outer wall surface of the cylinder may be damaged when inserted into the housing. This damage on the cylinder may deteriorate the sealing therebetween.

SUMMARY

It is an object of the present disclosure to provide a high-pressure pump having a configuration in which weight of a housing is reduced and a sealing between a cylinder and a housing is ensured.

A high-pressure pump includes a plunger, a cylinder and a housing. The plunger performs a reciprocating movement. The cylinder has a bottom portion, a cylindrical portion and a large-diameter cylindrical portion. Further, the cylinder has a cylinder inner wall on which the plunger reciprocatively slides. The cylinder defines pressurization chamber between the cylinder inner wall, a top surface of the plunger and an inner surface of the bottom portion. The cylinder has a suction port and a discharge port which communicate with the pressurization chamber. The housing has a small engaging hole with which outer walls of the bottom portion and the cylindrical portion are engaged by press-fit. The housing has a large engaging hole with which an outer wall of the large-diameter cylindrical portion is engaged by press-fit.

During a pressurization stroke of the above high-pressure pump, a cylinder inner wall and a plunger receive a fuel pressure from the pressurization chamber. Meanwhile, the housing does not receive the fuel pressure from the pressurization chamber. Moreover, the cylinder has the cylindrical portion and the large-diameter cylindrical portion. When inserting the large-diameter cylindrical portion into the large engaging hole, the cylindrical portion of the cylinder is not brought into contact with the housing. Thus, it is restricted that the cylindrical portion is damaged. The high liquid-tightness between the cylinder and the housing can be ensured.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Multiple embodiments of the present invention will be described with reference to accompanying drawings.

First Embodiment

Figure 1:
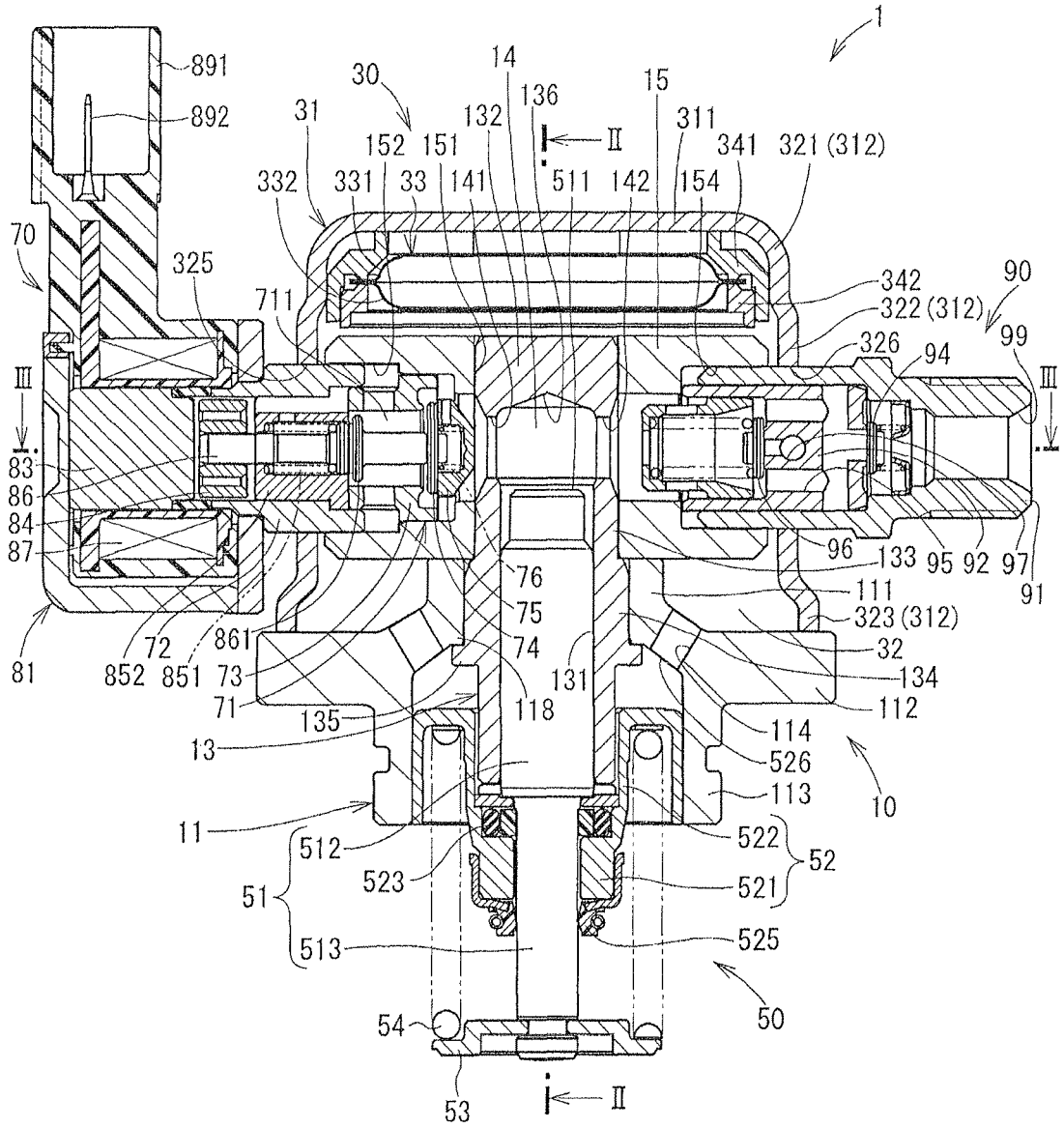
FIG. 1 is a cross-sectional view showing a high-pressure pump according to a first embodiment.
Figure 2:
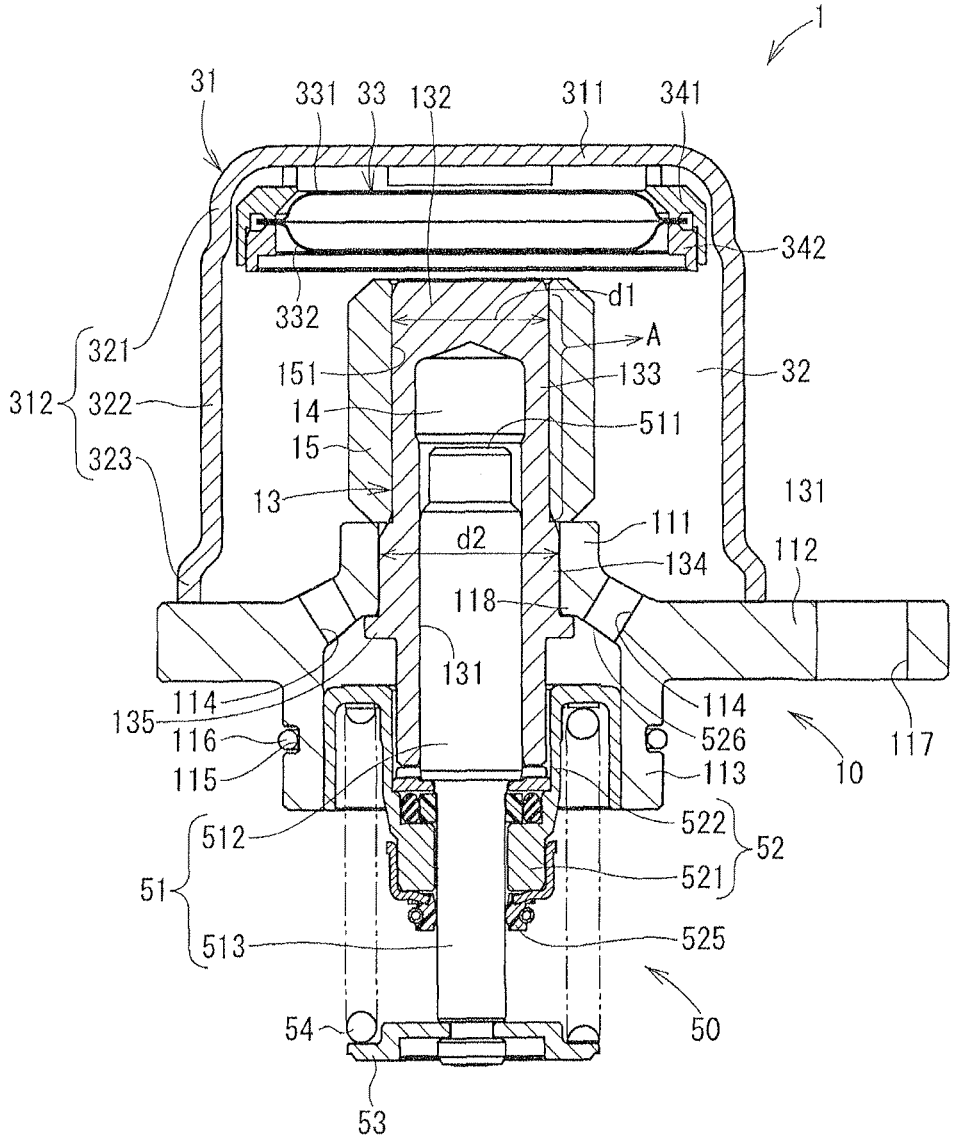
FIG. 2 is a cross-sectional view taken along a line II-II in FIG. 1.
Figure 3:
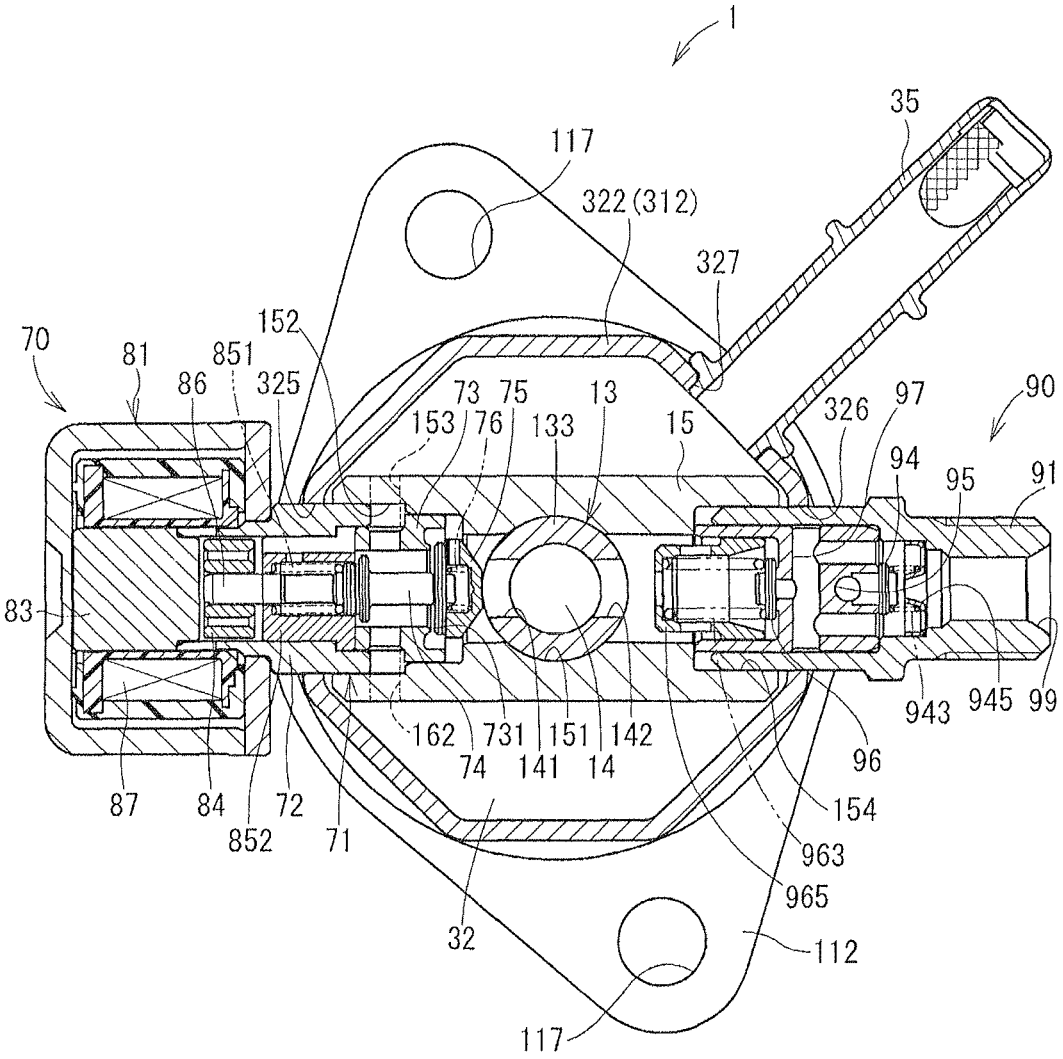
FIG. 3 is a cross-sectional view taken along a line in FIG. 1.

FIGS. 1 to 3 illustrate a high-pressure pump 1 according to a first embodiment. The high-pressure pump 1 supplies fuel pumped up from a fuel tank (not shown) by a low-pressure pump (not shown) to a pressurization chamber. Then, the fuel pressurized in the pressurization chamber is supplied to a fuel accumulator (not shown). The high pressure fuel in the fuel accumulator is injected into a combustion chamber through a fuel injector. The high-pressure pump 1 includes a body portion 10, a fuel supply portion 30, a plunger portion 50, a fuel suction portion 70, and a fuel-discharge-relief portion 90. In the following description, the upper side of FIG. 1 will be taken as "up", "upward" or "upper," and the low side of the FIG. 1 will be taken as "down", "downward" or "lower."

The body portion 10 includes a lower housing 11, a cylinder 13 and an upper housing 15. The lower housing 11 includes: a cylindrical cylinder-holding-portion 111; an annular flange portion 112 protruded from the lower part of the cylinder-holding-portion 111; and a cylindrical engaging portion 113 which is engaged with an engine (not shown). The cylinder-holding-portion 111 has a large-diameter engaging hole 121 in which the cylinder 13 is press-inserted.

The flange portion 112 has a plurality of fuel paths 114 through which fuel flows. As shown in FIG. 3, the flange portion 112 has bolt-through holes 117 through which a bolt (not shown) is inserted so that the flange portion is fixed on the engine.

The cylinder-holding-portion 111 and the cylindrical engaging portion 113 are grinded in order to be engaged with the engine. The lower housing 11 is made from stainless steel.

The cylinder 13 has an inner wall surface 131 on which the plunger 51 slides. The inner wall surface 131 defines a pressurization chamber 14 in cooperation with a top surface 511 of the plunger 51. When the plunger 51 slides up in the cylinder 13, the fuel in the pressurization chamber 14 is pressurized. The cylinder 13 includes a suction port 141 and a discharge port 142 which communicate with the pressurization chamber 14. The suction port 141 and the discharge port 142 are symmetrically arranged with respect to an axis of the plunger 51.

The hardness of the cylinder 13 is enhanced by heat treatment, such as quenching, in order to suppress seizure and wear due to sliding of the plunger 51.

As illustrated in FIG. 3, the upper housing 15 is substantially in a shape of a rectangular parallelepiped extending in a direction substantially orthogonal to an axis of the cylinder 13. The upper housing 15 is formed independently from the lower housing 11. The upper housing 15 has a press-insert hole 151 through which the cylinder 13 is inserted. The upper housing 15 and the cylinder 13 are fluid-tightly in contact with each other. Although the upper housing 15 and the lower housing 11 are in contact with each other in the present embodiment, it is not always required for them to be in contact with each other.

The upper housing 15 includes a stepped suction passage 152 and multiple communication passages 153. The suction passage 152 penetrates the upper housing 15 in a direction opposite to the pressurization chamber 14 in such a manner as to communicate with the suction port 141. The communication passages 153 orthogonally extend from the suction passage 152. The suction passage 152 and the communication passages 153 communicate with the pressurization chamber 14 through the suction port 141.

The upper housing 15 includes a stepped discharge passage 154 penetrating the upper housing 15 in a longitudinal direction thereof toward the opposite side to the pressurization chamber 14 with respect to the discharge port 142. The discharge passage 154 communicates with the pressurization chamber 14 through the discharge port 142.

The above press-insert hole 151, the suction passage 152, the communication passages 153 and the discharge passage 154 are formed by machining the upper housing 15. As long as these hole and passages can be formed in the upper housing 15, the upper housing 15 can be made thin to reduce its weight.

The fuel supply portion 30 will be described hereinafter.

The fuel supply portion 30 includes a cover 31, a pulsation damper 33, and a fuel inlet 35.

The cover 31 is cup-shaped. The cover 31 accommodates a top portion of the cylinder 13 and the upper housing 15. The cover 31 is comprised of a flat portion 311 and a cylindrical portion 312. The flat portion 311 closes an upper portion of the cylindrical portion 312. The cylindrical portion 312 is comprised of a first cylindrical portion 321, an octagonal portion 322 and a second cylindrical portion 323.

The first and the second cylindrical portion 321, 323 have a circular cross section. An inner diameter of the first cylindrical portion 321 is smaller than that of the second cylindrical portion 323.

The octagonal portion 322 has an octagonal cross section. The octagonal portion 322 has four pairs of flat walls. A minimum inside measurement of the octagonal portion is larger than an inner diameter of the first cylindrical portion 321. A maximum inside measurement of the octagonal portion is smaller than an inner diameter of the second cylindrical portion 323. The first cylindrical portion 321 and the second cylindrical portion 323 are connected to the octagonal portion 322 through curved walls, which enhances a rigidity of the cover 31.

The octagonal portion 322 has a first through-hole 325 and a second through-hole 326 which confront each other. A suction valve body 72 is inserted into the first through-hole 325. A fuel-discharge-relief housing 91 is inserted into the second through-hole 326.

Further, the octagonal portion 322 has a third through-hole 327 circumferentially adjacent to the second through-hole 326, as shown in FIG. 3. A based portion of the fuel inlet 35 is inserted into the third through-hole 327. The cover 31 is made of stainless steel. As long as a fuel gallery 32 can be defined inside of the cover 31, the cover 31 can be made thin to reduce its weight.

The cover 31, the flange portion 112, the suction valve body 72, the fuel-discharge-relief housing 91 and the fuel inlet 35 are respectively connected by welding. The cover 31 defines the fuel gallery 32 therein. The fuel gallery 32 communicates with the communication passages 153. The fuel in the fuel gallery 32 is supplied to the pressurization chamber 14 through the communication passages 153.

A pulsation damper 33 is arranged in the fuel gallery 32. The pulsation damper 33 is configured by joining together the peripheral edge portions of two diaphragms 331, 332. The pulsation damper 33 is sandwiched between an upper support member 341 and a lower support member 342 so as to be fixed on an inner wall of the first cylindrical portion 321. A gas of predetermined pressure is sealed inside of the pulsation damper 33. The pulsation damper 33 is elastically deformed according to change in the fuel pressure in the fuel gallery 32, whereby a fuel pressure pulsation in the fuel gallery 32 is reduced. The cover 31 functions as a housing member for the pulsation damper 33.

The plunger portion 50 will be described hereinafter. The plunger portion 50 includes a plunger 51, an oil seal holder 52, a spring seat 53, a plunger spring 54, and the like. The plunger 51 has a large-diameter portion 512 and a small-diameter portion 513. The large-diameter portion 512 slides on the inner wall 131 of the cylinder 13. The small-diameter portion 513 is inserted into an oil seal holder 52.

The oil seal holder 52 is placed at an end of the cylinder 13 and includes: a base portion 521 positioned on the circumference of the small-diameter portion 512 of the plunger 51; and a press-fit portion 522 press-inserted into the engaging portion 113 of the lower housing 11.

The base portion 521 has a ring-shaped seal 523 therein. The seal 523 is comprised of a ring located inside and an O-ring located outside. The thickness of a fuel oil film around the small-diameter portion 512 of the plunger 51 is adjusted by the seal 523 and the leakage of fuel to the engine is suppressed. The base portion 521 has an oil seal 525 at a tip end thereof. The thickness of an oil film around the small-diameter portion 512 of the plunger 51 is controlled by the oil seal 525 and oil leakage is suppressed.

The press-fit portion 522 is a portion cylindrically extending around the base portion 521. The extending cylindrical portion has "U-shaped" portion. A recessed portion 526 corresponding to the press-fit portion 522 is formed in the lower housing 11. The oil seal holder 52 is press-fit so that the press-fit portion 522 is press-inserted to the inner wall of the recessed portion 526.

A spring seat 53 is provided at an end of the plunger 51. The tip end of the plunger 51 is in contact with a tappet (not shown). The tappet has its outer surface abutted against a cam installed on a cam shaft and is reciprocatively moved in the axial direction according to the cam profile by the rotation of the cam shaft.

One end of the plunger spring 54 is engaged with the spring seat 53 and the other end of the plunger spring 54 is engaged with the press-fit portion 522. As a result, the plunger spring 54 functions as a return spring for the plunger 51 and biases the plunger 51 so as to abut against the tappet.

With this configuration, the plunger 51 is reciprocatively moved according to the rotation of the cam shaft. As this time, the volumetric capacity of the pressurization chamber 14 is varied by the movement of the large-diameter portion 511 of the plunger 51.

The fuel section portion 70 will be described hereinafter.

The fuel suction portion 70 includes a suction valve portion 71 and an electromagnetic driving unit 81. The suction valve portion 71 includes a suction valve body 72, a seat body 73, a suction valve member 74, a first spring holder 75, a first spring 76, and the like. The suction valve body 72 is joined to the upper housing 15 by press-fitting in the suction passage 152. The suction valve body 72 defines a suction chamber 711 therein. The suction chamber 711 communicates with the fuel gallery 32 through the communication passages 153. The cylindrical seat body 73 is placed in the suction chamber 711. A valve seat 731 (refer to FIG. 3) that can be abutted against the suction valve member 74 is formed on the seat body 73.

The suction valve member 74 is arranged inside of the seat body 73 in such a manner as to reciprocatively move in the suction chamber 711. When unseated from the valve seat 731, the suction valve member 74 fluidly connects the suction chamber 711 and the pressurization chamber 14. When seated on the valve seat 731, the suction valve member 74 fluidly disconnects the suction chamber 711 and the pressurization chamber 14. The first spring holder 75 is disposed in the suction chamber 711. A first spring 76 is provided inside of the first spring holder 75 in such a manner as to bias the suction valve member 74 toward the valve seat 731.

An electromagnetic actuator 81 is comprised of a fixed core 83, a movable core 84 and a needle 86. The movable core 84 is slidably arranged inside of the suction valve body 72. One end of the needle 86 is connected to the movable core 84. The needle 86 is reciprocatively supported by a second spring holder 852 fixed on the inner wall of the suction valve body 72. A stopper 861 of the needle 86 can be brought into contact with the second spring holder 862. A second spring 851 is provided inside of the second spring holder 852 in such a manner as to bias the needle 86 toward the suction valve member 74. The second spring 851 biases the movable core 84 in the valve opening direction with a force larger than a force with which the first spring 76 biases the suction valve member 74 in the valve closing direction.

The fixed core 83 is arranged inside of a connector 891. The connector 891 has a coil 87 and a terminal 892 for energizing the coil 87. When the coil 87 is energized, a magnetic attraction force is generated between the fixed core 83 and the movable core 84. The movable core 84 and the needle 86 are attracted to the fixed core 83, so that the suction valve body 74 seats on the seat body 73 to close the suction passage. When the coil 87 is deenergized, the second spring 851 biases the movable core 84 and the needle 86 toward the pressurization chamber 14, so that the suction passage is opened.

Then, the fuel-discharge-relief portion 90 will be described in detail, hereinafter.

The fuel-discharge-relief portion 90 includes a fuel-discharge-relief housing 91, a valve body 92, a discharge valve member 94 and a relief valve member 96. The fuel-discharge-relief housing 91 is press-inserted into the discharge passage 154 formed in the upper housing 15. The fuel-discharge-relief housing 91 accommodates the valve body 92, the discharge valve member 94 and the relief valve member 96.

The valve body 92 is cup-shaped and has an opening toward the pressurization chamber 14. The valve body 92 has a discharge passage 95 and a relief passage 97. These passages 95, 97 do not communicate with each other. The discharge passage 95 extends radially outwardly. Also, the relief passage 97 extends radially outwardly.

In the fuel-discharge-relief housing 91, the discharge valve member 94 is disposed adjacent to a bottom wall of the valve body 92. A discharge-valve-spring holder 945 holds a discharge valve spring 943. The discharge valve spring 943 biases the discharge valve member 94.

The relief valve member 96 is arranged in the fuel-discharge-relief housing 91. The relief valve member 96 is biased toward the relief passage 97 by a relief valve spring 963.

An operation of the high-pressure pump 1 will be described hereinafter.

(I) Suction Stroke

When the plunger 51 is moved down from the top dead center to the bottom dead center by rotation of the cam shaft, the volumetric capacity of the pressurization chamber 14 is increased and the fuel pressure in the pressurization chamber 14 is decreased. The discharge passage 95 is closed by the discharge valve member 94. At this time, since the coil 87 has not been energized, the movable core 85 is moved toward the pressurization chamber 14 by the biasing force of the second spring 85. The needle 86 biases the suction valve member 74 toward the first spring holder 75 to maintain the valve closed state. Thus, the fuel is suctioned into the pressurization chamber 14 from the suction chamber 711 through the suction port 141.

(II) Metering Stroke

When the plunger 51 is moved up from the bottom dead center to the top dead center by rotation of the cam shaft, the volumetric capacity of the pressurization chamber 14 is reduced. The energization of the coil 87 is stopped until a predetermined time. The suction valve member 74 is in the open state. Thus, a part of the fuel suctioned into the pressurization chamber 14 in the suction stroke 121 is returned to the suction chamber 711. When the energization of the coil 87 is started at the predetermined time in the process of the plunger 51 ascending, a magnetic attractive force is generated between the fixed core 83 and the movable core 84. When this magnetic attractive force becomes larger than a resultant force of the biasing forces of the second spring 851 and the first spring 76, the movable core 84 and the needle 86 are moved toward the fixed core 83 and the biasing force of the needle 86 against the suction valve member 74 is canceled. As a result, the suction valve member 74 is seated on the valve seat 731 formed on the seat body 73.

(III) Pressurization Stroke

After the suction valve member 74 is closed, the fuel pressure in the pressurization chamber 14 is increased with ascent of the plunger 51. When the fuel pressure force exerted on the discharge valve member 94 becomes larger than the following resultant force, the discharge valve member 94 is opened. The resultant force is a resultant of the pressure force of fuel in the fuel discharge port 99 and the biasing force of the discharge valve spring 943. Thereby, high-pressure fuel pressurized in the pressurization chamber 14 is discharged from the fuel outlet 99 through the discharge port 142.

As mentioned above, the high-pressure pump 1 repeats the suction stroke, the metering stroke, and pressurization stroke. The suctioned fuel is pressurized and discharged into the fuel accumulator through the fuel outlet 99.

When the fuel pressure in the fuel accumulator is less than a predetermined value, the relief valve is closed. However, the fuel pressure in the fuel accumulator may be increased due to a malfunction. When the fuel pressure force exerted on the relief valve member 96 exceeds a specified value, the relief valve member 96 is moved toward the pressurization chamber 14 and the relief valve 95 is opened. The specified value corresponds to the sum of the force exerted on the relief valve member 96 and the biasing force of the relief valve spring 963. As a result, the flow of fuel from the fuel discharge port 99 to the pressurization chamber 14 is permitted.

A configuration of the cylinder 13 will be described more in detail hereinafter.

The cylinder 13 is comprised of a flat portion (bottom portion) 132, a cylindrical portion 133 and a large-diameter cylindrical portion 134. An outer diameter "d1" of the cylindrical portion 133 is smaller than an outer diameter "d2" of the large-diameter cylindrical portion 134. The large-diameter cylindrical portion 134 is press-inserted into a large engaging hole 121 of the cylinder-holding portion 111.

An inner diameter of a small engaging hole 151 is smaller than that of the large engaging hole 121. The cylindrical portion 133 is inserted into the small engaging hole 151. The cylindrical portion 133 has the suction port 141 and the discharge port 142. The suction port 141 communicates with the pressurizing chamber 14. Also, the discharge port 142 communicates with the pressurizing chamber 14. The suction port 141, the discharge port 142, the suction passage 152 and the discharge passage 154 define a fuel passage.

An outer diameter of the cylindrical portion 133, which is denoted by an arrow "A" in FIG. 2, is constant. The cylindrical portion 133 is inserted into the small engaging hole 151 without any clearance therebetween.

The large-diameter cylindrical portion 134 has an annular protrusion 135 which is in contact with a cylinder-contacting portion 118 of the cylinder-holding portion 111, whereby a movement of the cylinder 13 is restricted.

Figure 4A:
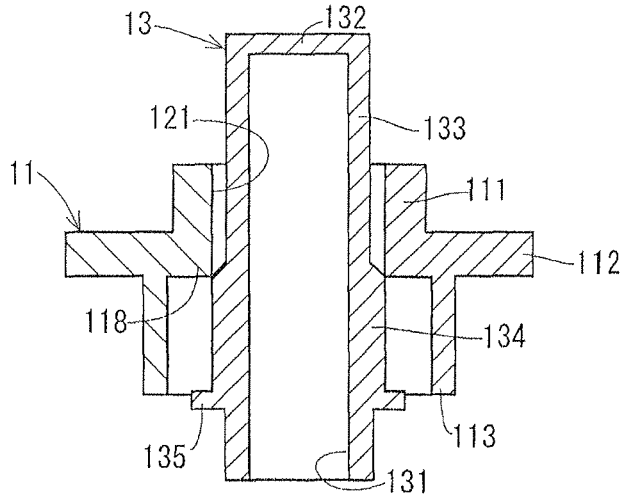
FIGS. 4A, 4B and 4C are schematic cross sectional views for explaining a method in which a cylinder is assembled to a lower housing of the high-pressure pump.
Figure 4B:
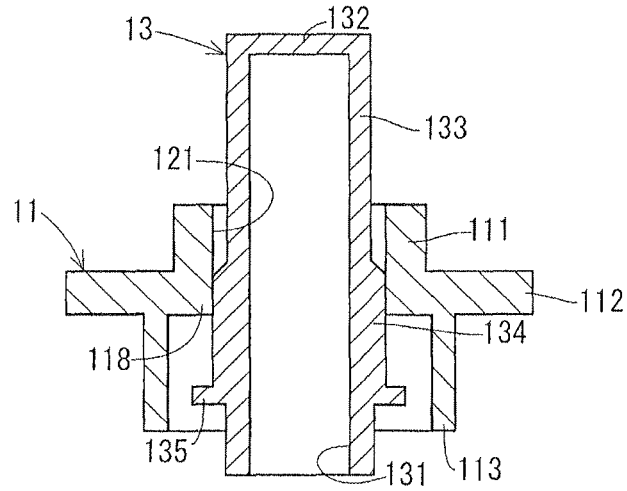
Figure 4C:
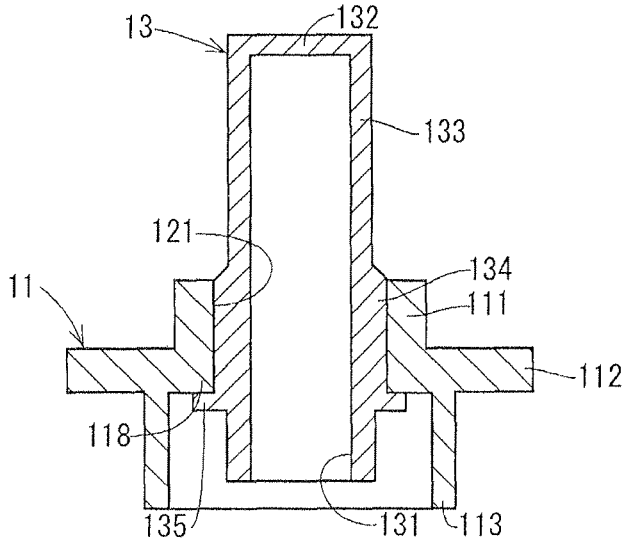

When assembling the cylinder 13 to the lower housing 11, the flat portion 132 of the cylinder is inserted into the small engaging hole 151 of the upper housing 15, as shown in FIG. 4A. The large-diameter cylindrical portion 134 is inserted into the large engaging hole 121 until the annular protrusion 135 is brought into contact with the cylinder-contacting portion 118, as shown in FIGS. 4B and 4C. The flat portion 132 and the outer wall of the cylindrical portion 133 are not in contact with the lower housing 11.

During the pressurization stroke, the cylinder inner wall 131 and the plunger 51 receive a fuel pressure from the pressurization chamber 14. Meanwhile, the upper housing 15 does not receive the fuel pressure from the pressurization chamber 14. Therefore, the upper housing 15 can be made thin. Further, since the housing is comprised of an upper housing 15 and the lower housing 11, the shapes thereof can be made simplified. The weight of the housing can be reduced.

According to the present embodiment, the cylinder 13 is comprised of the flat portion 132, the cylindrical portion 133 and the large-diameter cylindrical portion 134. When inserting the large-diameter cylindrical portion 134 into the large engaging hole 121, the flat portion 132 and the cylindrical portion 133 are not brought into contact with the lower housing 11. Thus, it is restricted that the flat portion 132 and the cylindrical portion 133 are damaged. The high liquid-tightness between the flat portion 132, the cylindrical portion 133 and the small engaging hole 151 can be ensured.

Further according to the present embodiment, the inner diameter of a large engaging hole 121 is greater than that of the small engaging hole 151. Thus, when inserting the large-diameter cylindrical portion 134 into the large engaging hole 121, it can be surely avoided that the inner surface of the large engaging hole 121 is brought into contact with the outer surface of the cylindrical portion 133.

The upper housing 15 has the suction passage 152 communicating with the pressurization chamber 14 through the suction port 141 and the discharge passage 154 communicating with the pressurization chamber 14 through the discharge port 142. Moreover, the outer diameter "d1" of the cylindrical portion 133 is constant. Thus, the outer surface of the cylindrical portion 133 can be brought into close contact with the inner surface of the small engaging hole 151. The sealing can be ensured between the upper housing 15 and the cylinder 13.

Further, since the outer surface of the cylindrical portion 133 can be brought into close contact with the inner surface of the small engaging hole 151 without any clearance, it can be avoided that a dead volume is formed in the suction passage 152 and the discharge passage 154.

The cylinder 13 has the annular protrusion 13 which is in contact with the cylinder-holding portion 111, whereby a movement of the cylinder is restricted.

Second Embodiment

In the following second to fifth embodiments, the substantially same parts and the components as the first embodiment are indicated with the same reference numeral and the same description will not be reiterated.

Figure 5:
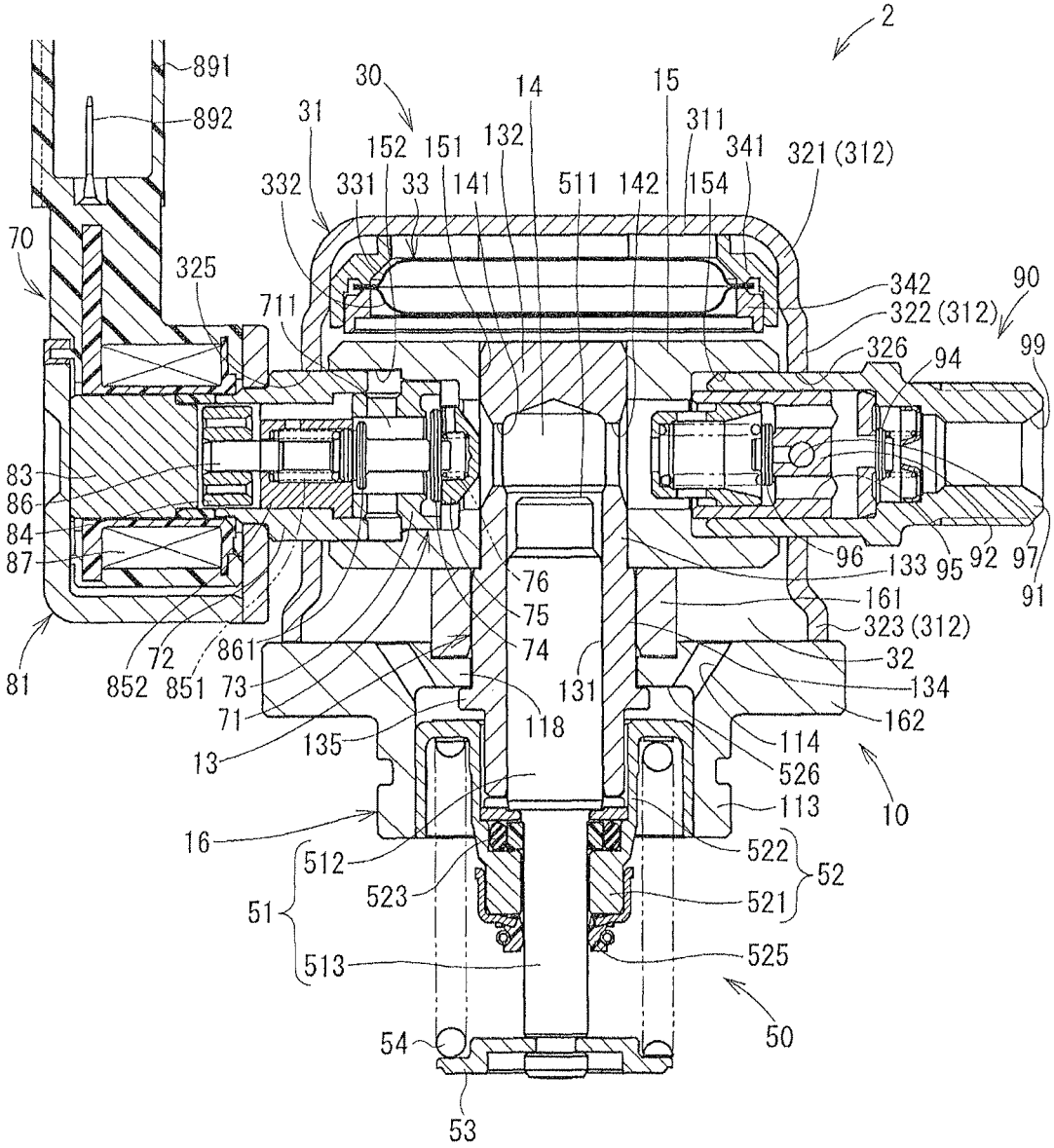
FIG. 5 is a cross-sectional view showing a high-pressure pump according to a second embodiment.

Referring to FIG. 5, a high-pressure pump 2 according to a second embodiment will be described hereinafter. The lower housing 16 of the high-pressure pump 2 has a cylinder-holding portion 161 which is formed independently from the flange portion 162. The cylinder-holding portion 161 includes the large engaging hole 121. The cylinder-holding portion 161 is sandwiched between the flange portion 162 and the upper housing 15. Since each component constituting the lower housing 16 has simple shape, the lower housing 16 can be easily manufactured.

Third Embodiment

Figure 6:
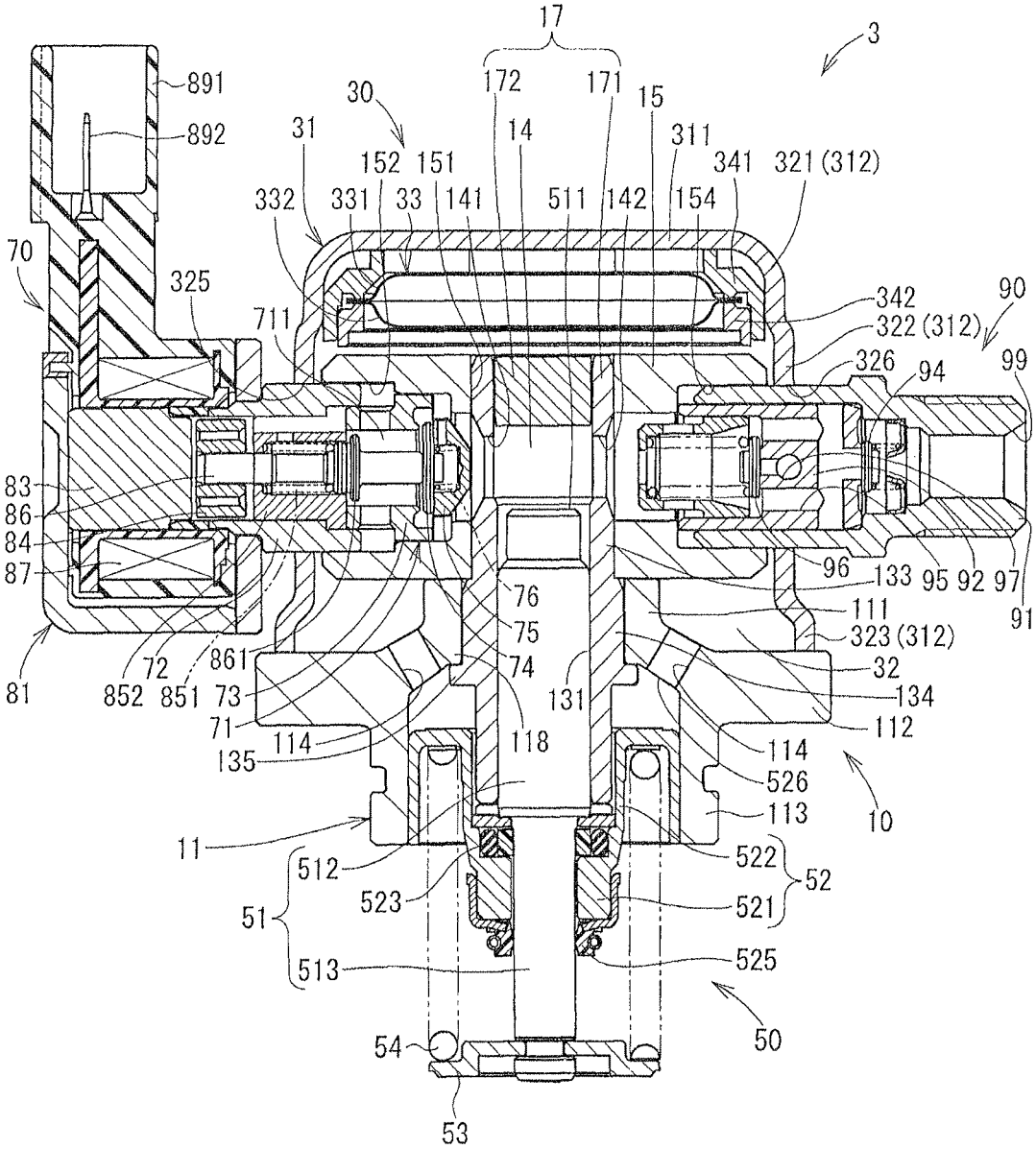
FIG. 6 is a cross-sectional view showing a high-pressure pump according to a third embodiment.

Referring to FIG. 6, a high-pressure pump 3 according to a third embodiment will be described hereinafter. The high-pressure pump 3 has a cylinder 17 of which one opening end is closed by a lid member 172. The inner wall surface of the cylinder can be easily grinded from its both opening ends.

Fourth Embodiment

Figure 7:
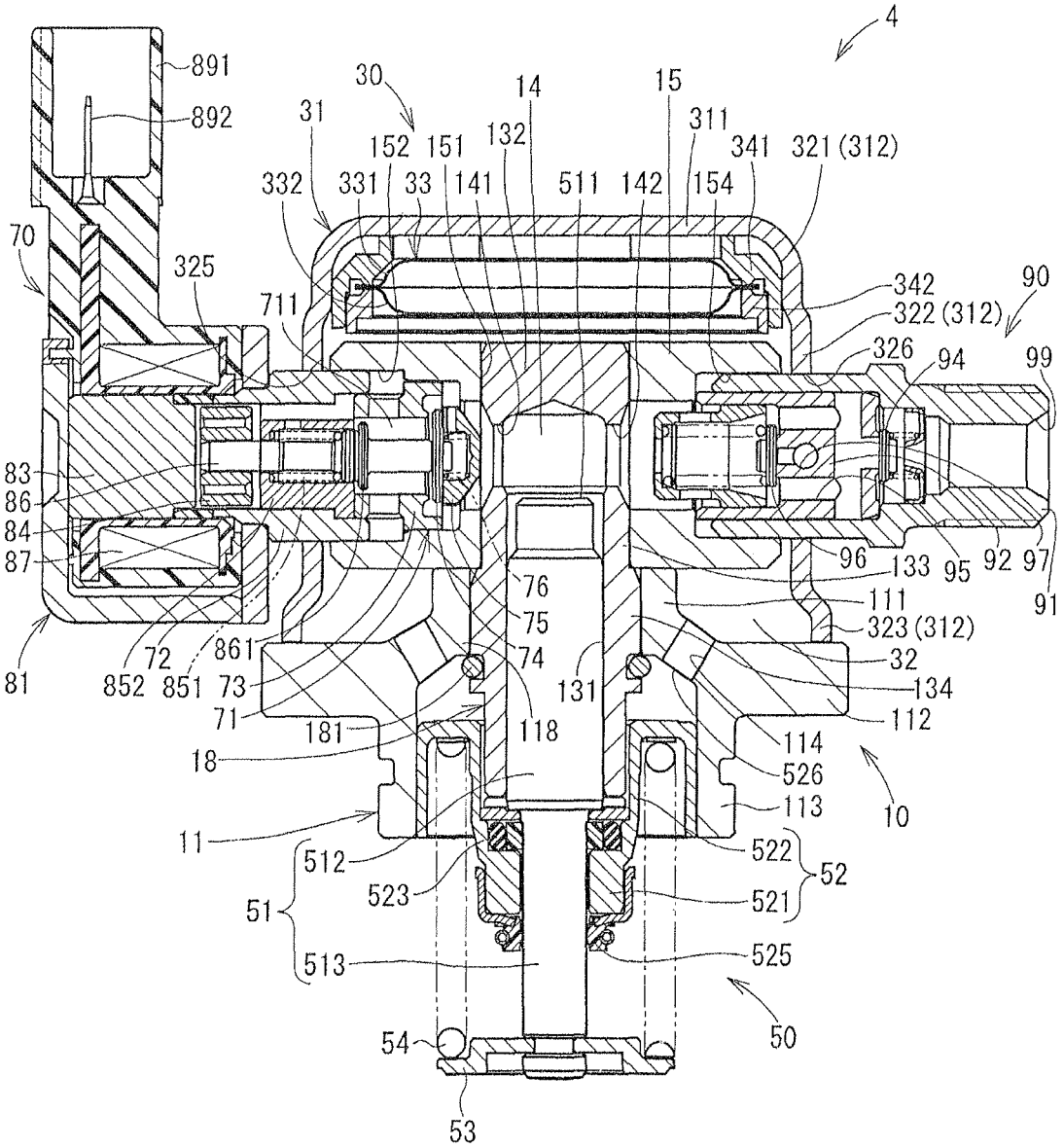
FIG. 7 is a cross-sectional view showing a high-pressure pump according to a fourth embodiment.
Figure 8A:
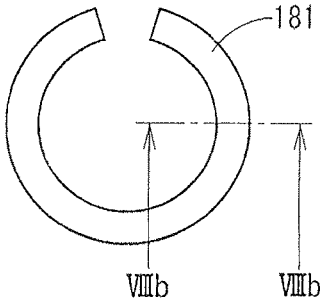
FIG. 8A is a front view of a fixing member.
Figure 8B:
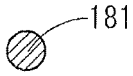
FIG. 8B is a cross-sectional view taken along a line VIIIb-VIIIb in FIG. 8A.

Referring to FIGS. 7, 8A and 8B, a high-pressure pump 4 according to a fourth embodiment will be described hereinafter. The cylinder 18 is provided with a fixing member 181 as a protruding portion. As shown in FIGS. 8A and 8B, the fixing member 181 is a snap ring of which cross section is circle. Before providing the fixing member 181, the outer surfaces of the cylindrical portion 133 and the large-diameter cylindrical portion 134 are grinded.

Fifth Embodiment

Figure 9:
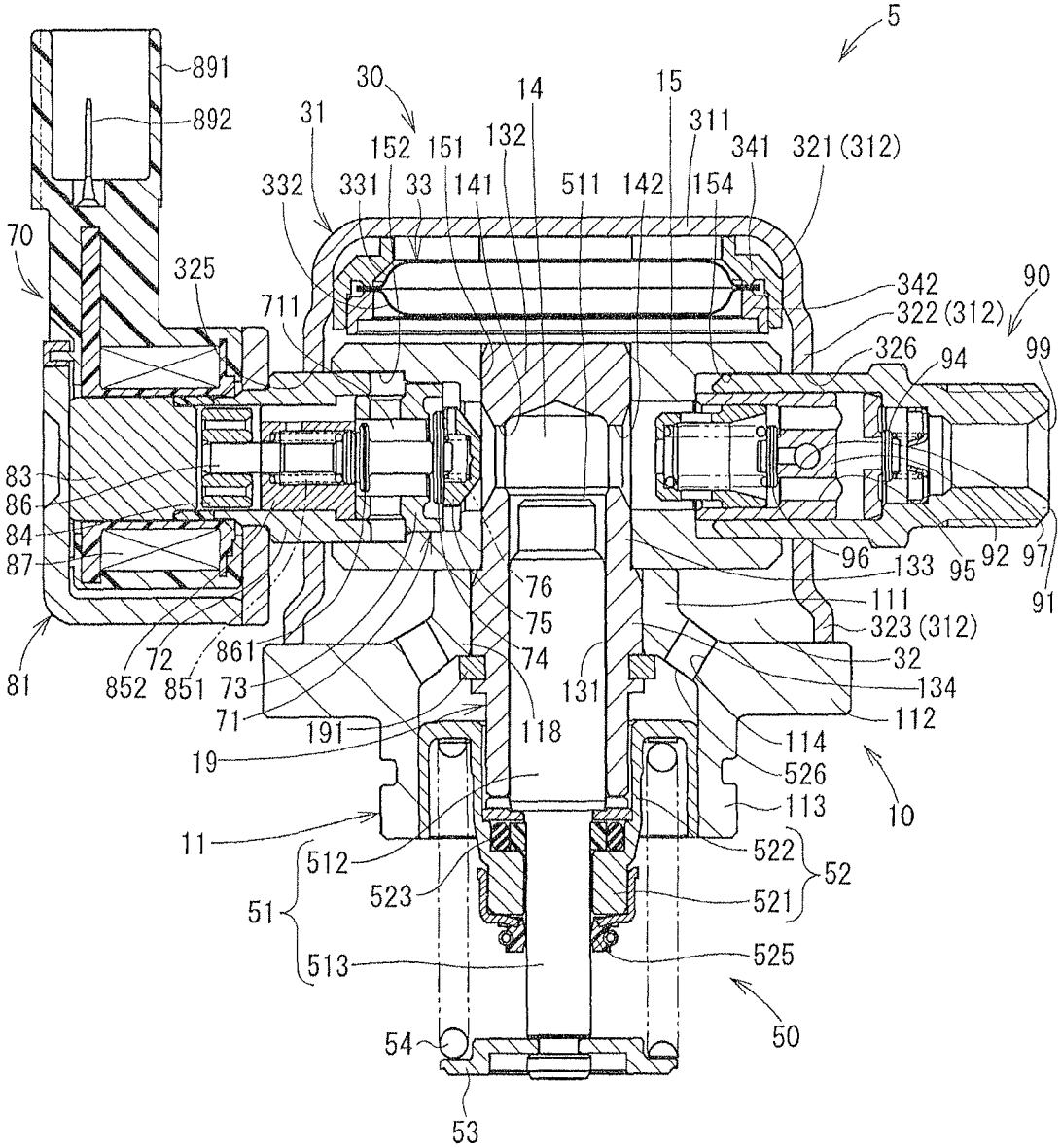
FIG. 9 is a cross-sectional view showing a high-pressure pump according to a fifth embodiment.
Figure 10A:
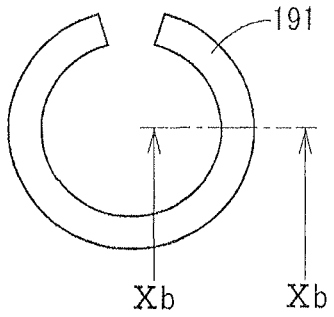
FIG. 10A is a front view of a fixing member.
Figure 10B:
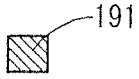
FIG. 10B is a cross-sectional view taken along a line Xb-Xb in FIG. 10A.

Referring to FIGS. 9, 10A and 10B, a high-pressure pump 5 according to a fifth embodiment will be described hereinafter. The cylinder 19 is provided with a fixing member 191 as a protruding portion. As shown in FIGS. 10A and 10B, the fixing member 191 is a snap ring of which cross section is square. Before providing the fixing member 191, the outer surfaces of the cylindrical portion 133 and the large-diameter cylindrical portion 134 are grinded.

Other Embodiment

Figure 11:
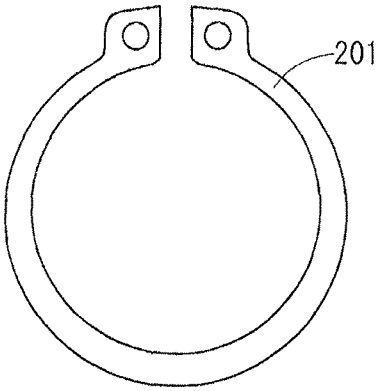
FIG. 11 is a front view of a fixing member according to another embodiment.
Figure 12:
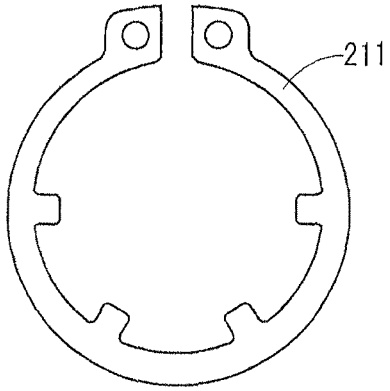
FIG. 12 is a front view of a fixing member according to the other embodiment.

The high-pressure pump may be used as a fluid pump that discharges a fluid to a device other than an engine. As the protruding portion provided on the cylinder, a fixing member 201 shown in FIG. 11 or a fixing member 211 shown in FIG. 12 may be applied.

The cylinder and the cylinder-holding portion can be connected by shrinkage fitting or expansion fitting. Also, the cylinder and the upper housing can be connected by shrinkage fitting or expansion fitting.

The present invention is not limited to the embodiments mentioned above, and can be applied to various embodiments.

What is claimed is:

1. A high-pressure pump comprising:

a plunger performing a reciprocating movement;

a cylinder having a cylinder inner wall on which the plunger reciprocatably slides;

a pressurization chamber defined between the cylinder inner wall and a top surface of the plunger;

the cylinder having a suction port and a discharge port which communicate with the pressurization chamber;

the cylinder having an annular protrusion which radially outwardly protrudes;

an upper housing having a suction passage which communicates with the suction port and a discharge passage which communicates with the discharge port;

a lower housing holding the cylinder and having an annular flange portion;

a cup-shaped cover having a first through-hole confronting the suction passage and a second through-hole confronting the discharge passage; the cup-shaped cover covers the upper and the lower housing and the cylinder for defining a fuel gallery into which a fuel flows;

a fuel suction portion disposed in the suction passage in such a manner as to extend through the first through-hole so that the fuel flowing into the pressurization chamber passes; and a fuel discharge portion disposed in the discharge passage in such a manner as to extend through the second through-hole so that the fuel discharged from the pressurization chamber passes, wherein the cup-shaped cover is formed independently from the upper and the lower housing, the cup-shaped cover has a thickness which is thinner than that of the cylinder, the cup-shaped cover covers the upper and the lower housing and the cylinder in a circumferential direction thereof;

the suction passage and the discharge passage are formed in such a manner as to be arranged on a same axis and the annular protrusion of the cylinder is in contact with the lower housing for restricting a movement if the cylinder.

2. A high-pressure pump according to claim 1, wherein the first through-hole of the cup-shaped cover and the fuel suction portion are connected by welding, and the second through-hole of the cup-shaped cover and the fuel discharge portion are connected by welding.

3. A high-pressure pump according to claim 1, further comprising:

a pulsation damper is arranged in the fuel gallery for reducing a fuel pressure pulsation in the fuel gallery.

4. A high-pressure pump according to claim 3, wherein the pulsation damper is arranged between a bottom portion of the cover and the upper housing.

5. A high-pressure pump according to claim 2, further comprising:

a pulsation damper is arranged in the fuel gallery for reducing a fuel pressure pulsation in the fuel gallery.

6. A high-pressure pump according to claim 1, wherein:

the cylinder includes a first cylindrical portion having a first outer diameter;

the cylinder includes a second cylindrical portion having a second outer diameter, the second outer diameter being larger than the first outer diameter; and the annular protrusion of the cylinder has a third outer diameter, the third outer diameter being larger than the second outer diameter.

7. A high-pressure pump according to claim 1, wherein:

the annular protrusion of the cylinder is positioned at an intermediate portion of the cylinder along an axial direction of the cylinder so as to be positioned between axial ends of the cylinder.

* * * * *